US011641950B2

(12) United States Patent
Davis et al.

(10) Patent No.: US 11,641,950 B2
(45) Date of Patent: May 9, 2023

(54) HEIGHT ADJUSTABLE BASSINET

(71) Applicant: Industrial Woodworking Corporation, Zeeland, MI (US)

(72) Inventors: Bradford L. Davis, Holland, MI (US); Lawrence W. Kelly, Zeeland, MI (US)

(73) Assignee: Industrial Woodworking Corporation, Zeeland, MI (US)

( * ) Notice: Subject to any disclaimer, the term of this patent is extended or adjusted under 35 U.S.C. 154(b) by 313 days.

(21) Appl. No.: 16/893,892

(22) Filed: Jun. 5, 2020

(65) Prior Publication Data

US 2021/0378417 A1 Dec. 9, 2021

(51) Int. Cl.

| | |
|---|---|
| ***A47D 1/04*** | (2006.01) |
| ***A47D 9/00*** | (2006.01) |
| ***A47D 7/00*** | (2006.01) |

(52) U.S. Cl.

CPC ..... *A47D 9/00* (2013.01); *A47D 7/007* (2013.01)

(58) Field of Classification Search

CPC ..... A47D 1/002; A47D 1/0081; A47D 1/023; A47D 1/04; A47D 7/007; A47D 9/00; A61G 12/001; A61G 3/0866; A61G 5/104; A61G 5/1059; A61G 13/06

See application file for complete search history.

(56) References Cited

U.S. PATENT DOCUMENTS

| | | | | |
|---|---|---|---|---|
| 4,537,445 | A * | 8/1985 | Neuhoff | A47C 1/03255 297/300.8 |
| 4,842,331 | A * | 6/1989 | Waples | A47D 1/0085 297/149 |
| 4,968,092 | A * | 11/1990 | Giambrone | A47D 1/0085 297/151 |
| 5,290,058 | A * | 3/1994 | Adams | A61G 12/001 280/47.35 |
| 5,806,111 | A * | 9/1998 | Heimbrock | A61G 1/0225 280/47.371 |
| 6,230,343 | B1 * | 5/2001 | Buiskool | A61G 7/012 5/610 |
| 7,302,717 | B2 * | 12/2007 | Reinke | B60B 33/0068 5/600 |

(Continued)

*Primary Examiner* — David R Hare
*Assistant Examiner* — Ifeolu A Adeboyejo
(74) *Attorney, Agent, or Firm* — Warner Norcross + Judd LLP

(57) ABSTRACT

A height adjustable bassinet with two height adjustable columns and associated assist cylinders. The bassinet includes a height adjustment assembly to operate the assist cylinders from manual actuators, such as paddles, located approximately in four corners of the bassinet support surface. The height adjustment system may include a pair of paddle assemblies mounted under the bassinet support surface. The paddle assemblies may be coupled to the assist cylinder by a dual linkage that translates pivotal movement of any individual paddle into movement sufficient to simultaneously actuate both assist cylinders. The dual linkage may include a pair of drive rods coupled to a pair of actuator rods by a plurality of pivot arms. The pivot arms may be generally "L" shaped and arranged in a rectangular configuration so that each drive rod is operatively coupled to two pivot arms and each actuator rods is operatively coupled to two pivot arms.

10 Claims, 12 Drawing Sheets

(56) References Cited

U.S. PATENT DOCUMENTS

| | | | | |
|---|---|---|---|---|
| 9,027,183 | B2 * | 5/2015 | Childs | A61G 1/0275 5/616 |
| 10,918,202 | B1 * | 2/2021 | Sie | A47B 9/06 |
| 2003/0112147 | A1 * | 6/2003 | George | A61B 5/4824 340/691.6 |
| 2004/0065238 | A1 * | 4/2004 | Chen | A47B 9/10 108/147 |
| 2009/0049603 | A1 * | 2/2009 | Martin | A61G 13/0018 5/83.1 |
| 2010/0231102 | A1 * | 9/2010 | Block | A61G 12/001 108/115 |
| 2013/0185867 | A1 * | 7/2013 | Long | A47D 7/02 5/100 |
| 2014/0310870 | A1 * | 10/2014 | Czach | A61G 7/0005 5/11 |
| 2016/0106226 | A1 * | 4/2016 | Yi | A47D 9/00 5/11 |
| 2016/0345722 | A1 * | 12/2016 | Chen | A47B 9/04 |
| 2018/0213927 | A1 * | 8/2018 | Sudoh | A47B 9/10 |
| 2018/0271733 | A1 * | 9/2018 | Davis | A61G 13/06 |
| 2019/0099012 | A1 * | 4/2019 | Zhang | A47D 13/061 |
| 2020/0046141 | A1 * | 2/2020 | Mu | A47D 9/00 |
| 2020/0268168 | A1 * | 8/2020 | Tully | A61G 11/005 |
| 2021/0076841 | A1 * | 3/2021 | Hu | A47D 9/02 |

* cited by examiner

HEIGHT ADJUSTABLE BASSINET

BACKGROUND OF THE INVENTION

The present invention relates to bassinets, and more specifically to medical grade bassinets of the type commonly used in a hospital and other medical environments.

Bassinets are often used in the medical industry to hold newborn babies and young infants, for example, up to about 4 months. In maternity wards and other medical environments, bassinets are often specially designed for use bedside as a place for a newborn or young infant to sleep or rest next to the mother's bed. For example, conventional bassinets used in a medical setting are often designed with rollers or wheels that allow the bassinet to be rolled up to the side of the mother's bed so that the mother can while remaining in bed interact with the newborn or young infant. Similarly, the bassinet can be rolled away from the bed when the mother is sleeping or when the newborn is resting in the nursery.

Bassinets are available in a variety of conventional designs, with each of the conventional designs suffering from shortcomings. For example, some conventional bassinets are supported upon a pedestal, chest of drawers or other fixed-height structure. Conventional fixed-height structures help to provide a stable support for the bassinet, but they can be heavy and bulky, and limit the mobility of the bassinet. Fixed-height structures can also make it more difficult for a mother to interact with a newborn in the bassinet. This can be particularly true when the mother is reclining in a height-adjustable bed. Fixed-height structures can also have a negative impact on caregiver ergonomics.

To facilitate bedside use, some conventional medical grade bassinets are height adjustable. For example, some bassinets are supported upon height adjustable columns that can be extended and retracted to raise and lower the height of the bassinet tub. While height adjustable bassinets are available, conventional height adjustment actuators can be difficult or inconvenient to operate.

Some conventional bassinets, including some conventional height adjustable bassinets, have drawers that can be used to store supplies and other items. In some conventional systems, the drawers can be opened from either side of the bassinet so that the user is not required to move to a specific side of the bassinet to gain access to the drawers. For example, some bassinets of this type include drawers fixed to conventional two-way drawer slides. While they provide easy movement of the drawers, conventional drawer slides are securely affixed to the drawers making it more difficult to clean the drawers. Perhaps an even bigger concern is that two-way drawers have a tendency to slide open when the bassinet is moved. For example, when rolling a mobile bassinet around a corner, the drawer will often slide open with centrifugal force caused by the inertia of the drawer and its contents. The problem is worsened when the drawer is holding a heavy load.

There is an ongoing need for an improved medical grade bassinet that provides enhanced performance and functionality in a maternity ward or other hospital or medical settings.

SUMMARY OF THE INVENTION

The present invention provides a bassinet that is height-adjustable and specially configured for bedside use in a medical environment. The bassinet generally includes a base, a pair of height adjustable columns, a bassinet support surface, a bassinet tub and a height adjustment assembly. In one embodiment, each column includes an assist cylinder having an actuator that is accessible through the top of the column. The height adjustment assembly includes an actuator assembly configured to operate both assist cylinders simultaneously through manual operation of actuators, such as paddles, located approximately in four corners of bassinet support surface.

In one embodiment, the height adjustment system includes a pair of paddle assemblies mounted under the bassinet support surface with one extending along each side. Each paddle assembly is operatively coupled to the assist cylinder actuator by a linkage so that manual operation of a paddle functions to actuate the assist cylinders to facilitate adjustment of the height of the bassinet support surface.

In one embodiment, each paddle assembly includes a spanning rod with paddles mounted at or near opposite ends. The spanning rod is rotatably mounted to the undersurface of the table top. The paddles may extend in a direction generally perpendicular to the longitudinal axis of the spanning rod so that up and down pivotal movement of a paddle causes rotation of the spanning rod.

In one embodiment, the spanning rods are operatively coupled to the assist cylinder actuator by a dual linkage, which is configured so that operation of any single paddle simultaneously operates both assist cylinder actuators, thereby allowing the bassinet support surface to be raised and lowered.

In one embodiment, the dual linkage includes a pair of drive rods, an array of pivot arms and a pair of actuator rods. In one embodiment, each drive rod is uniquely associated with one of the paddle assemblies. In one embodiment, each paddle assembly has a central leg that extends from the spanning rod and moves the associated drive rod when either paddle assembly is rotated into the release position. In one embodiment, the spanning rods extend generally longitudinally and the drive rods extend generally transversely with respect to the bassinet support surface. The central leg of each paddle assembly may engage the associated drive rod such that rotation of the spanning rod causes arcuate travel of the central leg, which in turn causes transverse linear movement of the drive rod.

In one embodiment, the array of pivot arms includes four pivot arms arranged between the two drive rods and the two actuator rods. Each of the actuator rods is uniquely associated with the actuator of an associated one of the assist cylinders such that reciprocating linear movement of an actuator rod results in selectively engaging or disengaging the actuators of both assist cylinders. The pivot arms are configured to translate movement of either drive rod into simultaneous movement of both actuator rods. For example, in the illustrated embodiment, a pair of pivot arms are uniquely associated with each of the drive rods, and a pair of pivot arms are uniquely associated with each of the actuator rods. The drive rods, pivot arms and actuator rods are arranged so that linear movement of either drive rod in a transverse direction causes pivoting movement of two associated pivot arms, which in turn causes linear movement of both actuator rods and both assist cylinder actuators.

In one embodiment, the pivot arms are disposed in a generally rectangular configuration. For example, each pivot arm may be generally L-shaped with a first leg engaging a drive rod and a second leg engaging an actuator rod.

In one embodiment, each drive rod includes a head configured to remain engaged with the two associated pivot arms through the full range of transverse motion of the drive rod.

In one embodiment, each actuator rod includes a head configured to remain engaged with the two associated pivot arms through the full range of longitudinal motion of the actuator rod.

In one embodiment, the height adjustment system is mounted to a support frame affixed to the top of the adjustable height columns and the bottom of the bassinet support surface. The support frame may be shaped to define a space housing the dual linkage in a concealed location between the support frame and the bassinet support surface.

In the illustrated embodiment, the actuator of the assist cylinder is resiliently biased in the locked position. In this embodiment, the actuator assembly components are arranged so that movement of the assist cylinder actuator into the locked position urges the various component of the actuator assembly into their respective locked position. As a result, the height of the bassinet support surface remains locked and the actuator assembly remains in the locked position except when a user is manually operating a paddle.

In one embodiment, the present invention includes a drawer disposed below the bassinet support surface. The drawer includes a drawer frame that is secured by two-way drawer slides that allow the drawer to be pulled out from either side of the bassinet. The drawer includes a removable tub that is fitted into the drawer frame. The drawer frame may include a pair of drawer fronts and a pair of drawer sides. The drawer tub may rest upon the drawer sides and be easily removed for cleaning by pulling out the drawer and lifting the drawer tub out of the drawer frame.

In one embodiment, the drawer includes a centering arrangement that helps to maintain the drawer in the centered/closed position. In one embodiment, the drawer frame is supported within a hanging pedestal by a pair of sidewalls. A finger extends outwardly from the approximate center of each drawer side toward the sidewalls. Each sidewall includes a pair of spring-loaded ball bearings (e.g. ball plungers) that are positioned along the path of the finger toward the center of the sidewall. The ball bearing are arranged so that the finger is situated between the two spring-loaded ball bearings when the drawer is in the centered/closed position, and so that the finger must be depress one of the ball bearings to move the drawer out of the centered/closed position. The amount of force required to move the drawer out of the centered/closed position can be controlled, for example, by varying the spring force of the ball plunger or by varying the shape of the portion of the finger that interfaces with the ball bearings.

In one embodiment, the present invention includes a pullout worksurface disposed below the bassinet support surface and above the dual linkage. The pullout worksurface is supported on raised portions of the support frame and can be pulled out from opposite ends of the bassinet.

In one embodiment, the worksurface includes a stop arrangement that limits movement of the worksurface to prevent it from being pulled out too far. In one embodiment, the worksurface includes a finger that extends up into a guide slot defined in the bottom of the bassinet support surface. The finger travels along the guide slot as the worksurface is moved. The range of motion of the pullout worksurface is defined by the length of the guide slot.

In one embodiment, the pullout worksurface has a centering assembly that helps to hold the worksurface in the closed position, which may be a centered position. The centering assembly may include a pair of spaced-apart spring-loaded bearings that extend into the guide slot and the path of the finger. The two spring-loaded bearings are spaced apart a distance slightly greater than the width of the finger. When the pullout worksurface is centered, the finger is positioned between the two bearings. To pull out the worksurface, the user must pull the worksurface with enough force to overcome the bias of the spring-loaded bearing.

The present invention provides a simple and effective height adjustment system for a bassinet having two height adjustable columns located remotely from one another. The height adjustment allows a user to actuate the height adjustment system from any of the four corners of the bassinet support surface. The use of a generally symmetric height adjustment system helps to balance the manual force required to operate the system for each of the corners. The use of paddle assemblies with a spanning rod and a central leg facilitates operation by centralizing the drive rods and allowing for actuator rods of generally equal length. Similarly, the use of a rectangular array of generally identical pivot arms provides a symmetric arrangement with uniform operation from all four paddles. The arrangement of four pivot arms allows inward motion of either drive rod to cause opposed linear movement of the two actuator rods, which in turn moves the two assist cylinder actuators from the locked to the unlocked position. Further, the internal bias of the assist cylinder actuators biases the actuator rods, the pivot arms, the drive rods, the spanning rods and the paddles into the locked position without the need for supplemental biasing components, such as springs. The use of a drop-in drawer tub makes it easy for a user to remove the drawer tub for cleaning, which is of increasing importance to user concerned with preventing the spread of infection. The pullout worksurface gives the user an additional surface that can be used when desired. Given that the bassinet support surface is generally supporting a bassinet tub, the pullout worksurface can be extremely convenient. The stop arrangement helps to retain the worksurface in the closed, center position until intentionally drawn out by the user. Further, it provides tactile feedback to the user as the moves the worksurface into the closed position.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION OF THE DRAWINGS

FIG. 9B is an enlarged view of Area 9B of FIG. 9A.

FIG. 10B is an enlarged view of Area 10B of FIG. 10A.

DESCRIPTION OF THE CURRENT EMBODIMENT

Figure 1A:
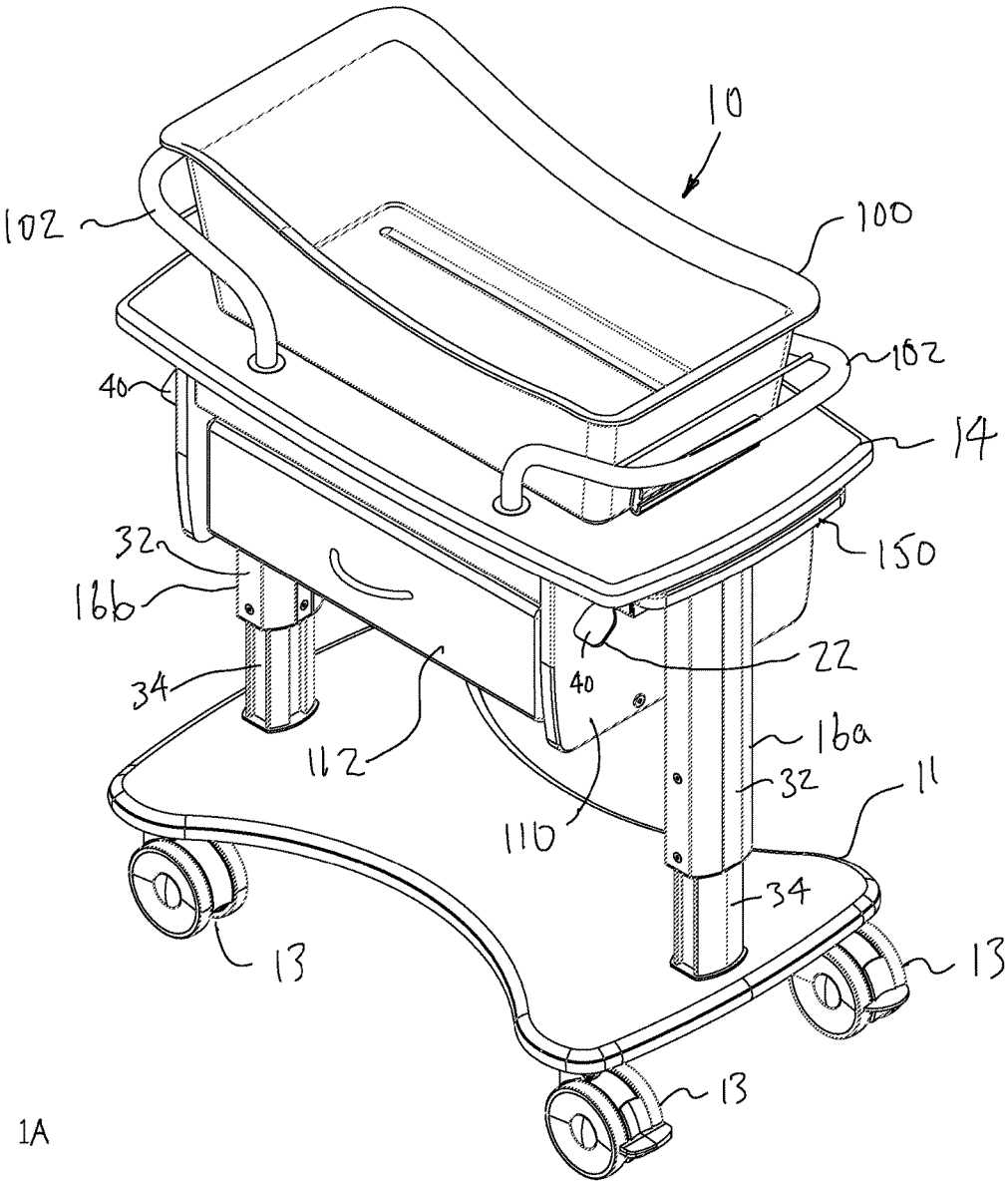
FIG. 1A is a top perspective view of a bassinet in accordance with an embodiment of the present invention.
Figure 1B:
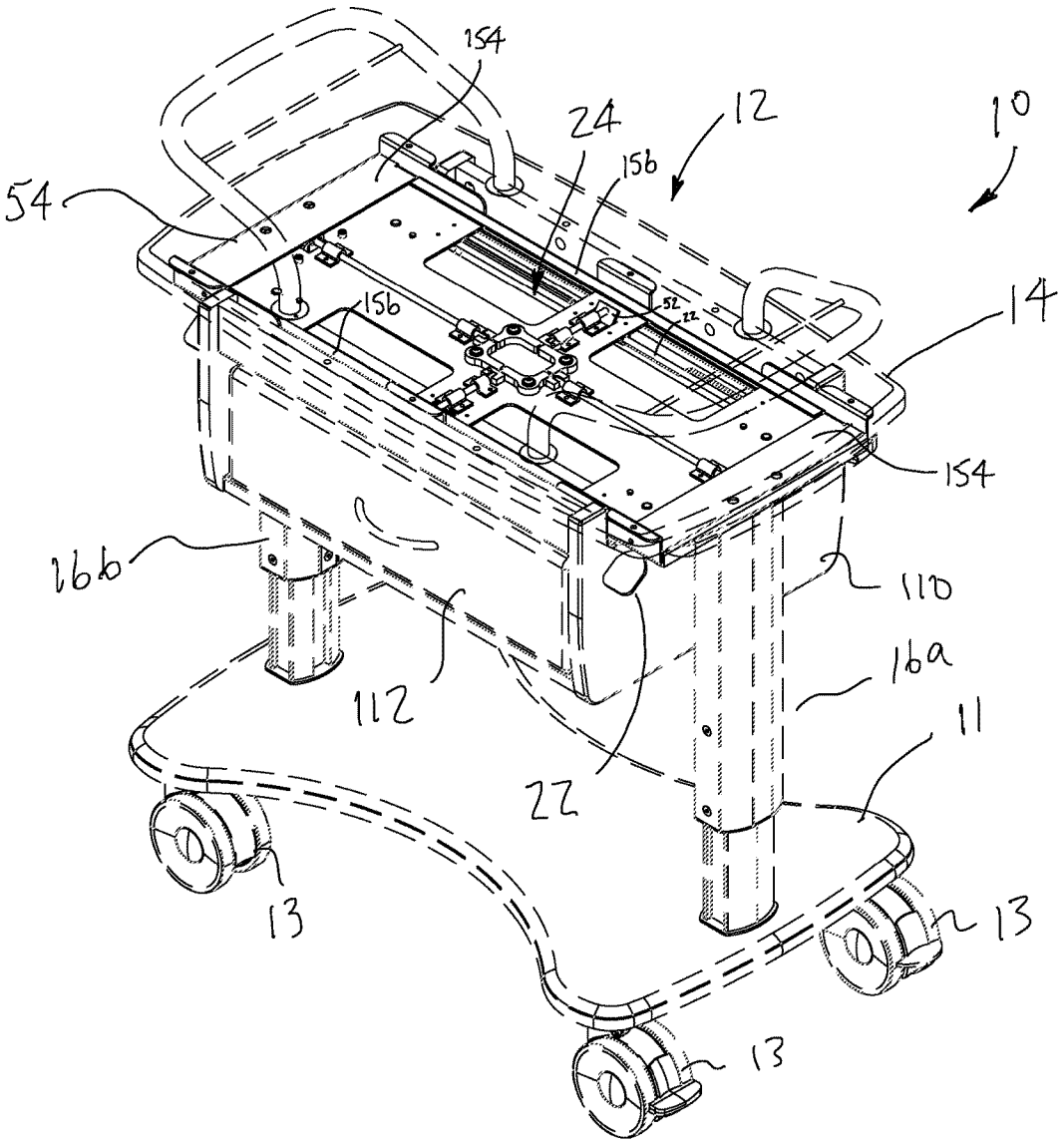
FIG. 1B is a top perspective view of a bassinet in accordance with an embodiment of the present invention with the bassinet tub removed and portions in broken lines to emphasize the height adjustment system.

A medical grade bassinet 10 having a height adjustment system 12 in accordance with an embodiment of the present invention is shown in FIGS. 1A and 1B. In this embodiment, the bassinet 10 includes a bassinet support surface 14 that is mounted upon a pair of height adjustable columns 16*a-b*. A bassinet tub 100 may be placed atop the bassinet support surface 14 within a pair of retention rails 102. An assist cylinder 18*a-b* is situated within each column 16*a-b*. The assist cylinders 18*a-b* each include an actuator 20*a-b* that is accessible from above the column 16*a-b* (See FIGS. 2A and 2B). The height adjustment system 12 includes an actuator assembly having a pair of paddle assemblies 22 that are rotatably mounted to the bassinet support surface 14 (See FIG. 3). The paddle assemblies 22 are operatively coupled to the actuator 20 by a linkage so that movement of any paddle moves the actuators 20 for both assist cylinders 18*a-b* to the unlocked position, thereby allowing adjustment to the height of the bassinet support surface 14 (See FIG. 4). In this embodiment, the paddle assemblies 22 are coupled to the actuator by a dual linkage 24 having a pair of drive rods 26, an arrangement of pivot arms 30 and a pair of actuator rods 28. In the illustrated embodiment, the height adjustment system 12 is essentially symmetrical in both the longitudinal and transverse directions.

Although described in the context of a bassinet, the height adjustment system of the present invention may be incorporated into other types of tables or work surfaces that incorporate a pair of remotely disposed assist cylinders. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The present invention will now be described in more detail with respect to the embodiment shown in FIGS. 1-10. In this embodiment, the bassinet 10 generally includes a base 11, a pair of height adjustable columns 16*a-b* affixed to and extending upwardly from the base 11, a pair of assist cylinders 18*a-b* (one mounted in each height adjustable column 16*a-b*), a bassinet support surface 14 mounted atop the height adjustable columns 16*a-b* and a bassinet tub 13 disposed atop the support surface 14. A bassinet tub 100 is disposed atop of the bassinet support surface 14 within retention rails 102. In the illustrated embodiment, the bassinet 10 also includes a hanging pedestal 110 suspended from the bassinet support surface 14. The hanging pedestal 110 includes a drawer 112 that can be opened from either side of the bassinet 10. In the illustrated embodiment, the bassinet 10 also includes a pullout worksurface 150 that is mounted in a cavity 152 defined below the bassinet support surface 14 and can be pulled out from either end of the bassinet 10.

In the illustrated embodiment, the base 11 provides a mobile pedestal to support the bassinet 10. As perhaps best shown in FIG. 1A, the base 11 includes a plurality of casters 13 that allow the bassinet 10 to be easily rolled about from one location to another. In alternative applications, the casters may be replaced by wheels, slides or other mechanisms that facilitate movement of the bassinet 10. In other alternative embodiments, the columns 16*a-b* may be attached to a base 11 without wheels or casters, or directly to floor or other underlying structure.

Referring again to FIG. 1A, the height adjustable columns 16*a-b* are affixed to the base 11, for example, by fasteners, welding or other types of attachment. As shown, the columns 16*a-b* are disposed toward opposite longitudinal ends of the base 11 to provide support near opposite longitudinal ends of the bassinet support surface 14. In the illustrated embodiment, the bassinet support surface 14 is generally rectangular. However, the size, shape and configuration of the bassinet support surface 14 may vary from application to application. For example, the bassinet support surface 14 may alternatively be square, oval, kidney shaped or essentially any other desired shape.

In the illustrated embodiment, the two columns 16 are essentially identical and each one is a telescopic column with an upper section 32 and a lower section 34 that are interfitted to different degrees to vary the height of the column and the bassinet support surface 14. In the illustrated embodiment, a bottom portion of the upper section 32 is telescopically fitted over an upper portion of the lower section 34. Bearing, bushings, rollers or other friction reducing components may be fitted between the upper section 32 and the lower section 34 to facilitate smooth and stable telescopic movement. In the illustrated embodiment, the lower section 34 of each column 16*a-b* is affixed to the base 11 and the upper section of each column is affixed to the undersurface of the bassinet support surface 14. The size, shape and configuration of the height adjustable columns 16 may vary from application to application.

To control and assist with telescopic movement of the columns 16*a-b*, an assist cylinder 18*a-b* is fitted into the interior of each column 16*a-b* between the upper section 32 and the lower section 34. In FIG. 2A, a portion of the upper section 32 of each column 16*a-d* is removed to show the upper end of each assist cylinder 18*a-b* emerging from inside the columns 16*a-b*. For example, one end of each assist cylinder 18*a-b* is directly or indirectly affixed to the associated upper section 32 and the other end of each assist cylinder 18*a-b* is directly or indirectly affixed to associated lower section 34. Each assist cylinder 18*a-b* has locked and unlocked states. In the locked state, the assist cylinders 18*a-b* prevent relative motion between the associated upper section 32 and lower section 34, thereby retaining the bassinet support surface 14 at the current height. In the unlocked state, the assist cylinders 18*a-b* allow relative motion between the associated upper section 32 and lower section 34.

The assist cylinders 18*a-b* of the illustrated embodiment include internal bias that helps to offset the weight of the height adjustable components of the bassinet 10 making it easier for the user to raise and lower the bassinet support surface 14. The assist cylinders 18*a-b* may be one of a variety of conventional assist cylinders available from a variety of well-known suppliers. For example, the assist cylinders 18*a-b* may be a Bloc-O-Lift locking gas spring (available from Stabilus GmbH) with a diameter of 28 mm, an extended length of 41 inches and a compressed length of 23 inches. The force of the gas spring may vary from application to application, for example, depending in part on the weight of the components of the bassinet 10 carried by the columns 16*a-b*. The described assist cylinders 18*a-b* and their specifications are merely exemplary.

Figure 2B:
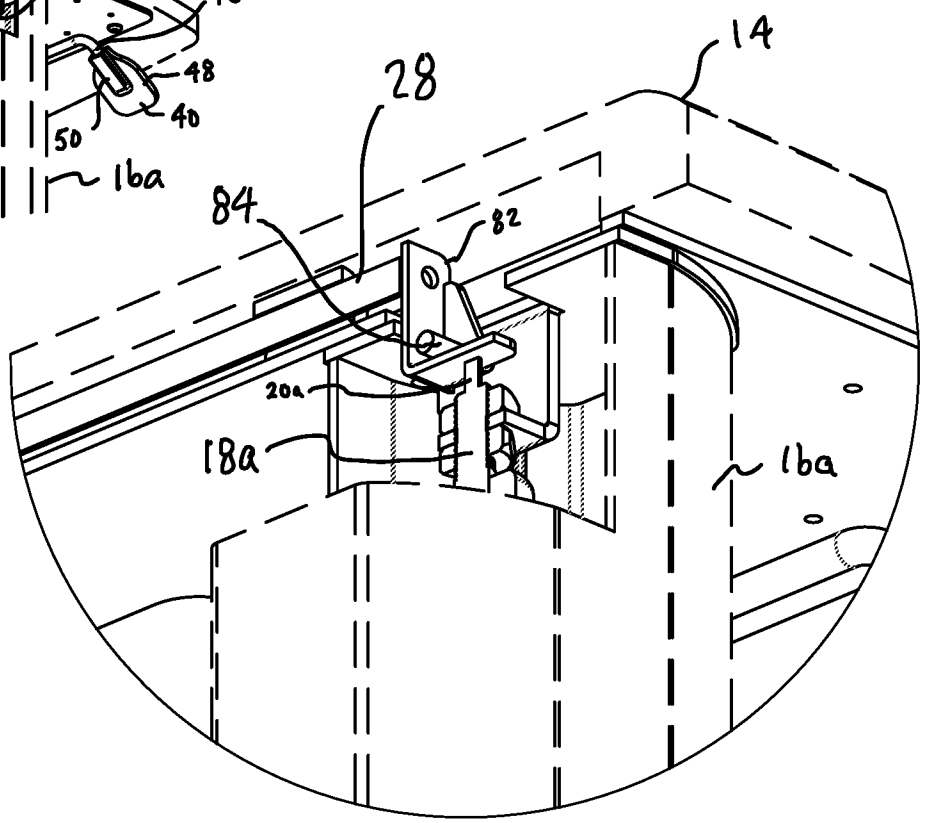
FIG. 2B is an enlarged view of a portion of FIG. 2A.
Figure 2A:
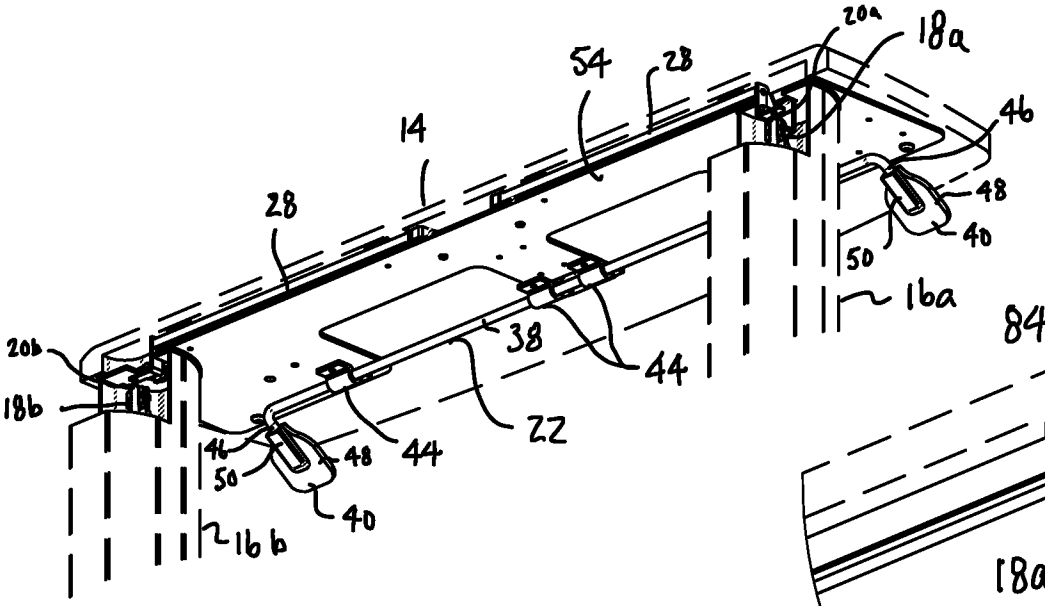
FIG. 2A is a sectional bottom perspective view of a portion of the bassinet.

In the illustrated embodiment, each assist cylinder 18*a-b* includes an actuator 20 that is mechanically manipulated to move the assist cylinder 18 between the locked and unlocked states (See FIGS. 2A and 2B). In the illustrated embodiment, the actuator 20 is biased in the locked position and user manipulation is required to move it into the unlocked position. For example, as perhaps best shown in FIG. 2B, the actuator 20 of the illustrated embodiment is a plunger that protrudes from the upper end of the assist cylinder 18. When the plunger 20 is extended, the assist cylinder 18*a-b* is in the locked state. When the plunger 20 is depressed, the assist cylinder 18*a-b* is in the unlocked state.

As noted above, the height adjustment system 12 of the illustrated embodiment also includes an actuator assembly that mounts to the undersurface of the bassinet support surface 14 and is operatively coupled to the assist cylinders 18*a-b* of both columns 16*a-b*. In use, the actuator assembly 36 provides a mechanism to allow manipulation of the assist cylinders 18*a-b* from a plurality of convenient locations about the bassinet support surface 14. The actuator assembly of this embodiment includes a pair of paddle assemblies 22 and a dual linkage 24 that operatively couples the paddle assemblies 22 to the assist cylinders 18*a-b*. The two paddle assemblies 22 are mounted along opposite longitudinal sides of the bassinet support surface 14. In the illustrated embodiment, each paddle assembly 22 includes a spanning rod 38 with paddles 40 mounted at or near opposite ends. The spanning rod 38 is rotatably mounted to the undersurface of the bassinet support surface 14. As shown in FIG. 2A, each spanning rod 38 may be affixed to the bassinet support surface 14 by a plurality of brackets 44. The brackets 44 may be sized to closely receive the spanning rods 38 with sufficient clearance to allow rotational movement of the spanning rods 38 within the brackets 44. Bearings, bushing or other friction reduction materials may be fitted between the brackets 44 and the spanning rods 38. As discussed below, the spanning rods 38 may also be attached to support frame 54.

The paddles 40 may extend in a direction generally perpendicular to the longitudinal axis of the spanning rod 38 so that up and down pivotal movement of a paddle 40 causes rotation of the associated spanning rod 38 about its longitudinal axis. In the illustrated embodiment, each paddle 40 is designed to be operated by a single hand. For example, the paddles 40 include a handle portion 48 configured for easy manipulation and a mounting portion 50 configured for attachment to a spanning rod 38 (See FIG. 2A). To facilitate mounting of the paddles 40, the spanning rods 38 of the illustrated embodiment may include opposed end segments 46 that extend at approximately 90 degrees to the longitudinal axis of the spanning rods 38. In this embodiment, the mounting portion 50 of each paddle 40 defines a mounting hole that is fitted over the free end of the corresponding lateral segment 46. A set screw (not shown) may be used to secure each paddle 40, if desired. The illustrated paddles 40 are merely exemplary. The size, shape and configuration of the paddles may vary from application to application. Although referred to as "paddle" assemblies, the paddle assemblies 22 need not include "paddles", but may instead include other structures suitable for manually rotating the assemblies 22. By way of example, the paddles may be replaced by essentially any alternative structure suitable for providing handles to operate the height adjustment system 12. The paddles need not be separate from the spanning rods. For example, the ends of the spanning rods 38 may be bent or otherwise configured to form paddles that can be manipulated directly without any separate components.

In the illustrated embodiment, each spanning rod 38 includes a radial leg 52 configured to interact with a linkage that operatively joins each paddle assembly 22 to both assist cylinders 18*a-b*. In the illustrated embodiment, the radial legs 52 extend radially from the corresponding spanning rod 38 in a generally upward direction from the approximate center of the spanning rod 38. The radial legs 52 extend upwardly through corresponding openings 86 in the support frame 54 (discussed below). As the paddle assembly 22 is rotated the radial leg 52 travels in a sweeping motion (compare FIGS. 6, 7 and 8). In the illustrated embodiment, the sweeping motion of the radial leg 52 is used to impart linear motion to a mating component in the dual linkage 24. More specifically, as described in more detail below, each radial leg 52 is configured to directly engage and provide linear motion to the associated drive rod 26.

The paddle assemblies 22 are operatively coupled to the actuator 20 so that appropriate rotational movement of either paddle assembly 22 moves the assist cylinder actuators 20 to the unlocked position, thereby allowing adjustment to the height of the bassinet support surface 14 and the various components carried by the bassinet support surface 14.

Figure 3:
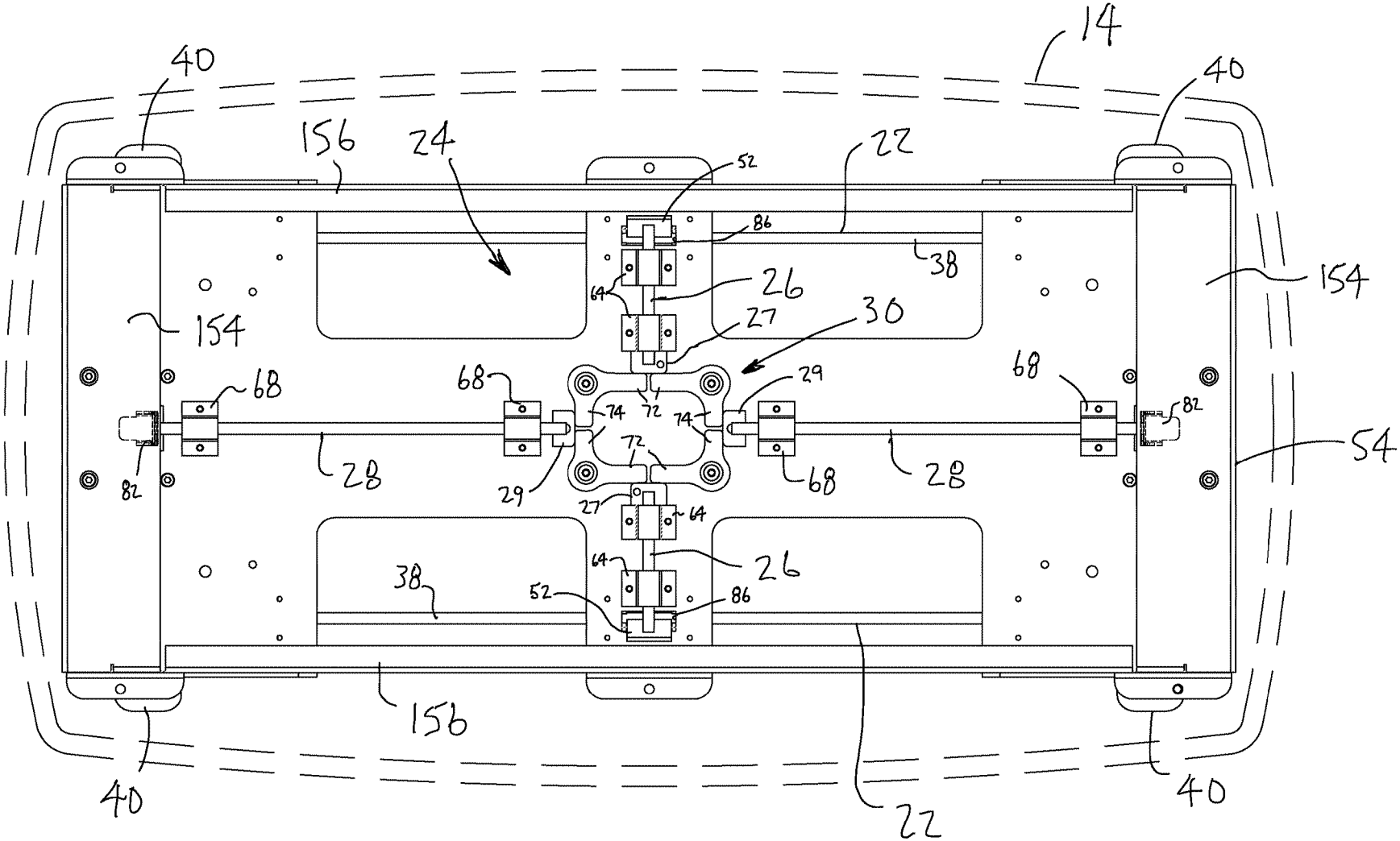
FIG. 3 is a top view of the height adjustment system in the locked position with the outline of the bassinet support surface shown in broken lines.
Figure 4:
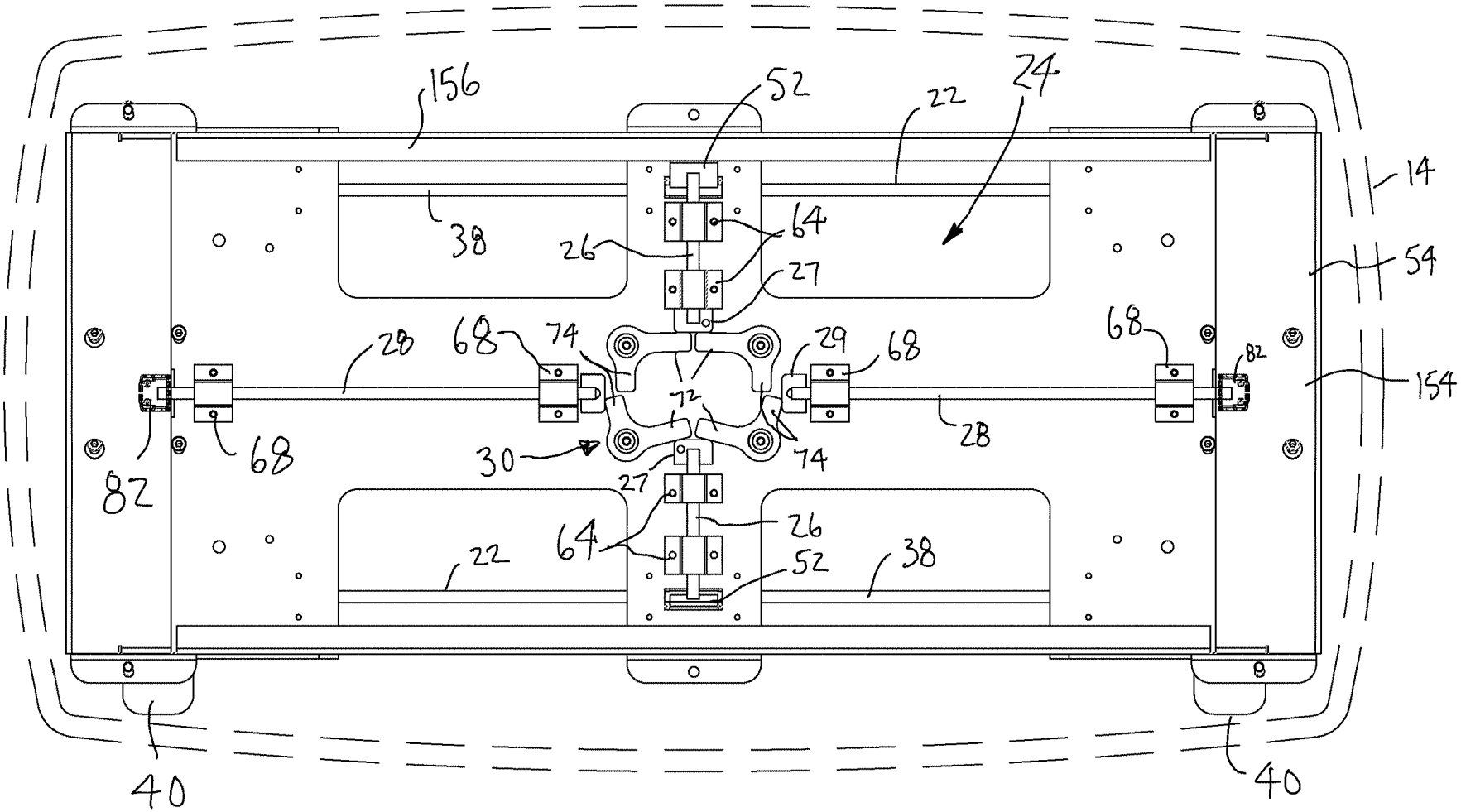
FIG. 4 is a top view of the height adjustment system in the unlocked position with one of the drive rod moved inwardly with the outline of the bassinet support surface shown in broken lines.

In the illustrated embodiment, the paddle assemblies 22 are coupled to the actuator 20 by a dual linkage 24 having a pair of drive rods 26, a pair of actuator rods 28, a plurality of pivot arms 30 and a pair of links 82. As shown in FIGS. 3 and 4, the drive rods 26 are mounted to the undersurface of the bassinet support surface 14 and are capable of reciprocating linear movement. For example, in the illustrated embodiment, each drive rod 26 is affixed to the support frame 54 by a pair of brackets 64. The illustrated brackets 64 are attached to the undersurface of bassinet support surface 14 by fasteners and are configured to allow linear movement of the drive rods 26. Each bracket 64 may include bushings, bearings or other components to reduce friction and allow easy movement of the drive rod 26 with respect to the bracket 64. Each drive rod 26 is disposed between a paddle assembly 24 and the plurality of pivot arms 30, and more specifically between the radial leg 52 of the associated spanning rod 38 and two associated pivot arms 30. Each drive rod 26 includes a head 27 configured to engage a pair of associated pivot arms 30. Because the associated pivot arms 30 swing away from each other during operation, the head 27 is of sufficient size to remain in contact with both pivot arms 30 throughout the full range of motion.

Similar to the drive rods 26, the actuator rods 28 are mounted to the undersurface of the bassinet support surface 14 and are capable of reciprocating linear movement. In the illustrated embodiment, each actuator rod 28 is affixed to the support frame 54 by a pair of brackets 68 (See FIGS. 3 and 4). The illustrated brackets 68 are attached to the undersurface of bassinet support surface 14 by fasteners and are configured to allow linear movement of the actuator rods 28. Each bracket 68 may include bushings, bearings or other components to reduce friction and allow easy movement of the actuator rods 28. Each actuator rod 28 is disposed between the plurality of pivot arms 30 and a link 82. More specifically, each actuator rod 28 is disposed between a corresponding pair of pivot arms 30 and a corresponding link 82. Each actuator rod 28 includes a head 29 configured to engage the associated pair of pivot arms 30. Because the associated pivot arms 30 swing away from each other during operation, the head 29 is of sufficient size to remain in contact with the associated pivot arms 30 throughout the full range of motion.

The dual linkage 24 includes a pair of links 82 that translate outwardly linear movement of the actuator rods 28 into downward movement of the assist cylinder actuators 20. In this embodiment, a separate link 82 is positioned between each actuator rod 28 and the corresponding assist cylinder actuator 20. As shown, each link 82 of the illustrated embodiment is a generally "L" shaped component that is pivotally mounted adjacent to an associated actuator 20. For example, as shown in FIG. 2B, each link 82 may be affixed by a pin 84 that supports the link 82 and permits it to pivot with respect to the column 16*a-b*. Although the illustrated links 82 are generally "L" shaped, the linkage 24 may include one or more alternative components capable of operating the actuators 20 in response to linear movement of the actuator rods 28. In use, each link 82 translates generally outward linear movement of the corresponding actuator rod 28 into generally downward motion appropriate to depress the corresponding actuator 20 and release the corresponding assist cylinder 18*a-b*.

In this embodiment, the array of pivot arms 30 are configured to translate inward linear motion of the drive rods 26 into outward linear motion of the actuator rods 28. As shown, the drive rods 26 are arranged approximately normal to the actuator rods 28. In this embodiment, the bassinet support surface 14 is generally rectangular and the paddle assemblies 22 extend along opposite longitudinal edges of the bassinet support surface 14. As a result, the drive rods 26 move linearly in a transverse direction and the actuator rods 28 move linearly in a longitudinal direction. Referring again to FIGS. 3 and 4, the dual linkage 24 of the illustrated embodiment includes four pivot arms 30 arranged in a generally rectangular array. Each illustrated pivot arm 30 is generally L-shaped, including a first leg 72 and a second leg 74 arranged at about 90 degrees from one another. Each pivot arm 30 is pivotally secured to the undersurface of the bassinet support surface 14 at the vertex of the first leg 72 and the second leg 74. For example, a through-hole may be defined at the vertex and the pivot arm may be secured to the undersurface of the bassinet support surface 14 (e.g. support frame 54) by a fastener extending through the through-hole. Bushings, bearings or other components intended to reduce friction may be disposed within the through-hole about the fastener to facilitate smooth, easy and uniform pivotal motion of the pivot arm 30. The first leg 72 of each pivot arm 30 is operatively engaged with the corresponding drive rod 26 and more specifically with the head 27 of the corresponding drive rod 26. The second leg 74 of each pivot arm 30 is operatively engaged with a corresponding actuator rod 28 and more specifically the head 29 of the corresponding actuator rod 28.

Figure 5:
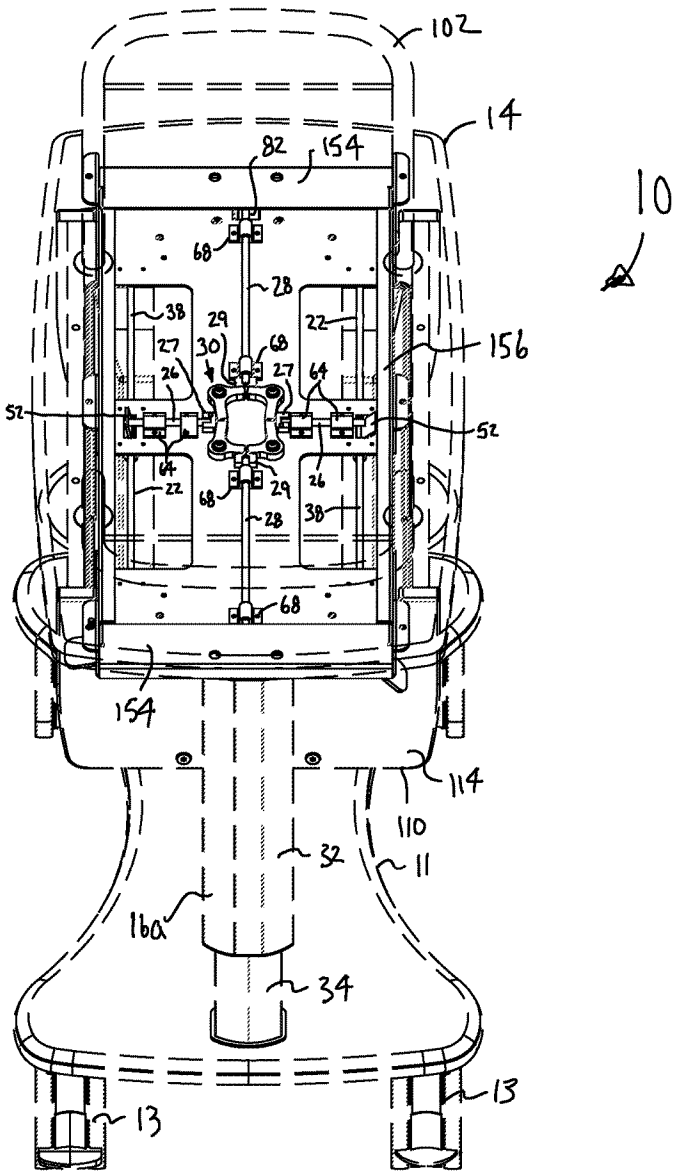
FIG. 5 is a perspective view of the bassinet with various components shown in broken lines to show the height adjustment system in the locked position with the bassinet tub removed and portions in broken lines to emphasize the height adjustment system.
Figure 6:
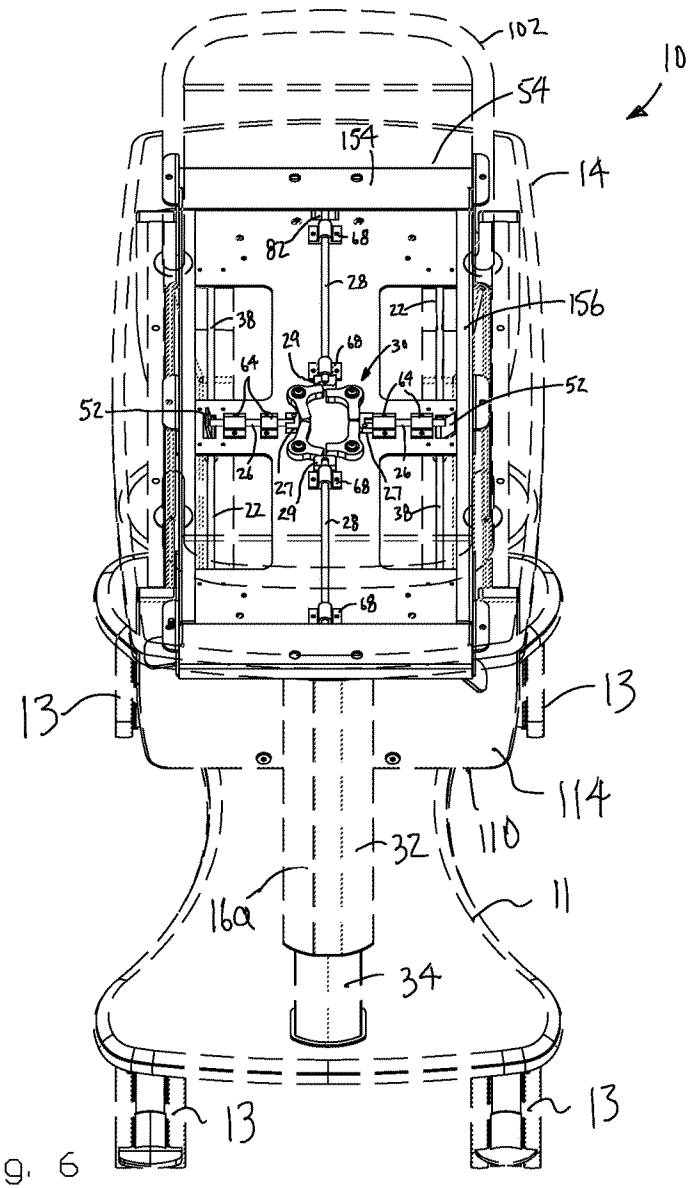
FIG. 6 is a perspective view of the bassinet with various components shown in broken lines to show the height adjustment system in the unlocked position with the bassinet tub removed and portions in broken lines to emphasize the height adjustment system.

Operation of the height adjustment assembly 12 will now be described with reference to FIGS. 3 and 4 and to FIGS. 5 and 6. In use, upward movement of any one of the four paddles results in rotational movement of the corresponding spanning rod 38, which in turn moves the radial leg 52 of that spanning rod 38 inwardly. Inward movement of the radial leg 52 moves the associated drive rod 26 linearly inward into the two associated pivot arms 30, and more specifically the head 27 of the moving drive rod 26 operatively engages and moves inwardly the first leg 72 of each associated pivot arm 30. Inward movement of the first legs 72 causes each of the two associated pivot arms 30 to pivot about its mounting point pivoting the second leg 74 outwardly into operative engagement with the associated actuator rod 28. As shown, the second leg 74 of each moving pivot arm 30 operatively engages the head 29 of the corresponding actuator rod 28 with the two pivot arms 30 pushing the actuator rods 28 outwardly in opposite directions. This outward movement causes each actuator rod 28 to engage and move the corresponding link 82. The links 82 pivot to translate the outward linear movement of the actuator rods 28 into downward depression of the actuators 20, thereby simultaneously releasing the assist cylinder 18*a-b* of both columns 16*a-b* and allowing the bassinet support surface 14 to be raised or lowered as desired. Transition between the locked and unlocked conditions may be best seen by comparing FIG. 3 (locked) to FIG. 4 (unlocked) and comparing FIG. 5 (locked) to FIG. 6 (unlocked).

If desired, the lengths of the drive rods 26 and/or the actuator rods 28 may be adjustable to allow tuning of the dual linkage 24. For example, an adjustment screw (not shown) may be threaded into the outer end of each drive rod 26 and/or each actuator rod 28. The adjustment screw may be threaded into or out of the rod to vary the effective overall length of that rod. Alternatively or in addition, one or more adjustment screws may be installed in the legs 72, 74 of the pivot arms 30 and/or the radial legs 52 of the spanning rods 38 to allow adjustment.

In the illustrated embodiment, the height adjustment assembly 12 is configured to be generally symmetrical about the transverse and longitudinal axes of the bassinet support surface. For example, the paddles assemblies 22 are generally identical and each has a centrally positioned radial leg 52. The two drive rods 26 are generally identical and extend along a generally central transverse axis. The two actuator rods 28 are generally identical and extend along a generally central longitudinal axis. The pivot arms 30 are centrally located and arranged so that inward movement of either drive rod 26 results in equal and opposite outward movement of both actuators rods 28. As a result of these symmetries, the dual linkage 24 (and more generally the height adjustment assembly 12) is balanced and provides stable and uniform operation from all four paddles.

In the illustrated embodiment, the assist cylinder actuator 20 is biased in the locked position (See FIGS. 2A and 2B). The actuator assembly 36 is configured to use the bias in the assist cylinder actuator 20 to bias the various components of the height adjustment assembly 12 in their locked positions. More specifically, when the user ceases applying enough force to a paddle assembly 22 to unlock the assist cylinders 18*a-b*, the bias of the assist cylinder actuators 20 urge the bottom legs of the links 82 upwardly causing the opposite legs of the links 82 to pivot inwardly forcing the associated actuator rods 28 to move inwardly. The inwardly moving actuator rods 28, in turn, engage and move the second legs 74 of the pivot arms 30, thereby pivoting second legs 74 inwardly and the first legs 72 outwardly. The outward movement of the first legs 72 of the pivot arms 30 pushes both of the drive rods 26 outwardly in opposite directions. Each drive rod 26 engages and swings the associated radial leg 52 outwardly, such that the associated paddle assembly 22 and attached paddles, move into the locked position.

In the illustrated embodiment, the bassinet support surface 14 includes a support frame 54 that carries the height adjustment system 12. The illustrated support frame 54 is affixed to the top of the column 16 and the bottom of the bassinet support surface 14. For example, in this embodiment, the support frame 54 is secured to both columns 16*a-b* and the bassinet support surface 14 by fasteners. In the illustrated embodiment, the undersurface of the bassinet support surface 14 is shaped to receive the dual linkage 24. For example, the bassinet support surface 14 may include one or more voids into which the dual linkage 24 is fitted. In the illustrated embodiment, the paddles assemblies 22 are secured to the undersurface of the support frame 54. For example, as perhaps best shown in FIG. 2A, each paddle assembly 22 may be rotatably affixed to the support frame 54 by brackets 60. The brackets 60 may be secured to the support frame by screws or other fasteners. Although mounted to the top surface of the support frame 54, the dual linkage 24 may alternatively be mounted to the bottom surface of the support frame 54. As noted above, the radial legs 52 may extend from below the support frame 54 to the dual linkage 24 mounted atop the support frame 54. For example, the radial legs 52 may extend through openings 86 of sufficient size to accommodate the radial legs 52 through their full range of motion. The support frame 54 is merely exemplary and the dual linkage 24 may be mounted to the table 10 using essentially any suitable alternative construction. For example, the dual linkage 24 may be secured directly to the bassinet support surface 14. In that alternative, the brackets securing the various components to the support frame 54 can be used to secure those components directly to the undersurface of the bassinet support surface 14.

Figure 7:
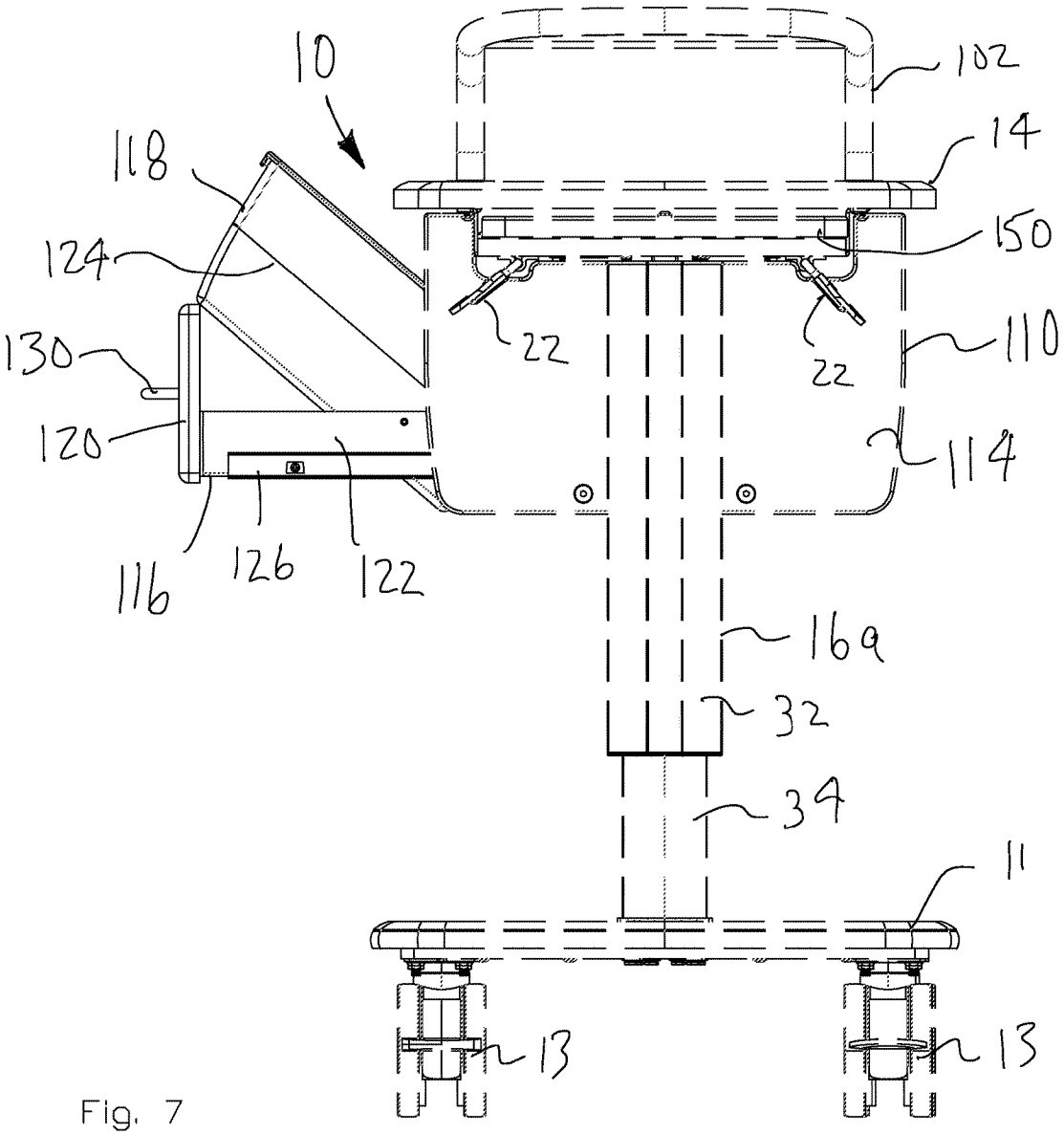
FIG. 7 is an end view of the bassinet showing a drawer tub being removed from the drawer with the bassinet tub removed and portions in broken lines to emphasize the drawer.
Figure 8:
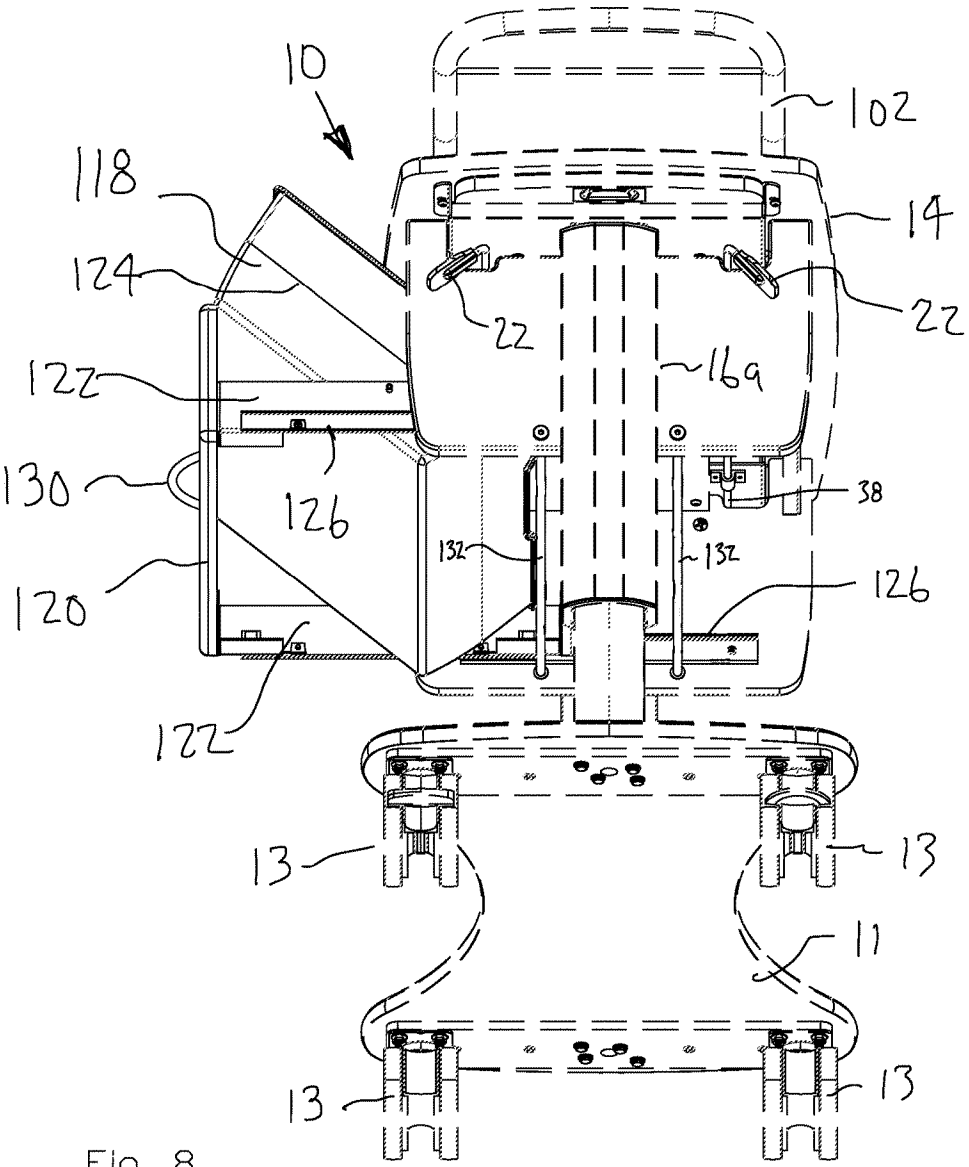
FIG. 8 is a perspective view of the bassinet showing a drawer tub being removed from the drawer with the bassinet tub removed and portions in broken lines to emphasize the drawer.

As noted above, the bassinet 10 of the illustrated embodiment also includes a hanging pedestal 110 including a drawer 112 that can be opened from either side of the bassinet 10 (See FIGS. 7 and 8). In this embodiment, the hanging pedestal 110 includes a pair of sidewalls 114. The sidewalls 114 may be mounted to the bassinet support surface 14, the support member 54 and/or the upper sections of the adjustable height support columns 16*a-b*. A pair of supports 132 may extend between the sidewalls 114 as shown in FIG. 8 to provide supplemental support to the sidewalls 114. The supports 132 may be rods affixed at opposite ends to the sidewalls 114. The drawer 112 generally includes a drawer frame 116 and a drawer tub 118. The drawer frame 116 of the illustrated embodiment includes a pair of drawer fronts 120 and a pair of drawer sides 122 arranged in a rectangular configuration. The drawer frame 116 defines a rectangular opening configured to receive and seat the drawer tub 118. In the illustrated embodiment, the drawer tub 118 includes contoured sidewall that forms a central shoulder 124. The central shoulder 124 is configured to rest up the tops of the two drawer sides 122 when the drawer tub 118 is properly seated in the drawer frame 116. In this embodiment, the drawer frame 116 is movably mounted to the pedestal sidewalls 114 by a pair of drawer slides 126. The drawer slides 126 support opposite sides of the drawer frame 116. In this embodiment, the drawer slides 126 are two-way drawer slides that allow the drawer 112 to be pulled out from either side of the bassinet 14. In the illustrated embodiment, the drawer tub 118 is a molded one-piece component that can be easily cleaned and disinfected. The drawer tub 118 may be molded from Kydex or other suitable materials. Although FIGS. 7 and 8 shows the drawer 112 pulled out from one side of the bassinet 10, the drawer 112 may alternatively be pulled out from the opposite side of the bassinet 10. Although the illustrations only show the drawer front 120 on one side of the drawer 112, the drawer 112 of the illustrated embodiment includes an identical drawer front 120 on the opposite side of the bassinet 10. Both drawer fronts 120 have a handle 130 that can be grasped and pulled to pull out the drawer 112 from either side of the bassinet.

Figure 11A:
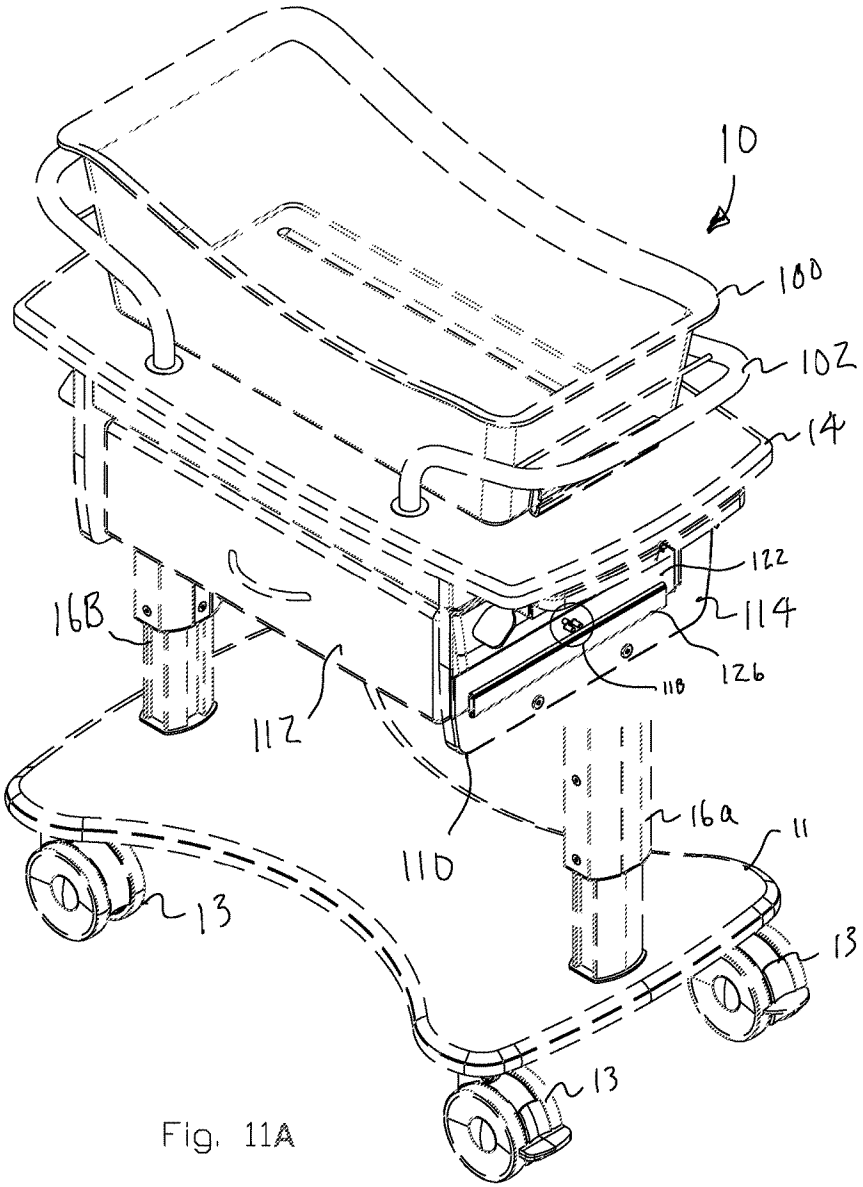
FIG. 11A is a perspective view of the bassinet with portions in broken lines and portions removed to show the centering arrangement on one side of the drawer.
Figure 11B:
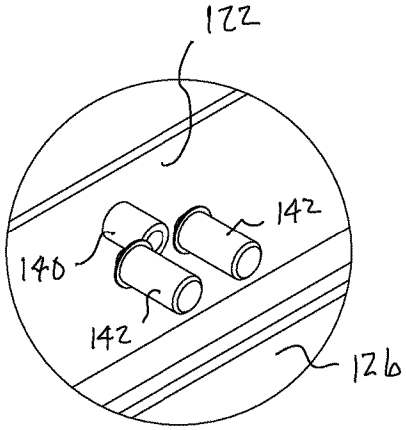
FIG. 11B is an enlarged view of Area 11B of FIG. 11A.
Figure 11C:
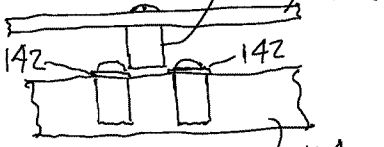
FIG. 11C is a sectional view showing the drawer centering arrangement on one side of the drawer.

In the illustrated embodiment, the drawer 112 includes a centering arrangement that helps to maintain the drawer 112 in the centered/closed position (See FIGS. 11A and 11B). In this embodiment, the centering arrangement includes a pair of fingers 140—one extend outwardly from the approximate center of each drawer side 122 toward the sidewalls 114. Being affixed to the drawer sides 122, the fingers 140 will travel along a generally linear path as the drawer 112 is opened and closed from either side of the bassinet 10. The centering arrangement also includes two pairs of spring-loaded ball bearings 142 (e.g. ball plungers)—one pair of spring-loaded ball bearings 142 mounted in each sidewall 114 along the path of the corresponding finger 140. On each side of the drawer 112, the spring-loaded ball bearings 142 are mounted toward the center of the sidewall and are arranged so that the corresponding finger 140 is situated between the two spring-loaded ball bearings 142 when the drawer 112 is in the centered/closed position. For example, each pair of spring-loaded ball bearings 142 may be spaced apart just enough distance to accommodate the corresponding finger 140 there-between (See FIG. 11C). Although FIGS. 11A-C shows the finger 140 and spring-loaded ball bearings 142 on only one side of the drawer 112, it should be noted than an essentially identical arrangement with a finger 140 and pair of spring-loaded ball bearings 142 is provided on the opposite side of the drawer 112. Because the spring-loaded ball bearings 142 are positioned along the path of the finger 140, the finger 140 must depress one of the two spring-loaded ball bearings 142 (depending on direction of travel) to move the drawer 112 out of the centered/closed position. More specifically, the drawer 112 must be moved with enough force for the fingers 140 on opposite sides of the drawer 112 to push the corresponding ball bearings into the plunger far enough for the fingers 140 to pass over the ball bearings. The amount of force required to move the drawer 112 out of the centered/closed position can be controlled, for example, by varying the spring/bias force of the ball plunger or by varying the shape of the portion of the finger 140 that interfaces with the ball bearings 142. In the illustrated embodiment, the centering arrangement is tuned so that the force required to move the drawer 112 out of the centered position is great enough to prevent the drawer 112 from opening unintentionally while the bassinet 10 is being moved. The centering arrangement also provides the user with tactile feedback when an open drawer 112 is properly returned to the centered/closed position because each finger 140 will again have to pass over a spring-loaded ball bearing 142 as the drawer 112 is centered.

Also as noted above, the illustrated embodiment of the present invention includes a pullout worksurface 150 that can be pulled out from either end of the bassinet 10 (See FIGS. 9A-B and 10A-B). In this embodiment, the worksurface 150 is mounted in a cavity defined below the bassinet support surface 14 and above the dual linkage 24. In the illustrated embodiment, the support frame 54 is configured to receive and support the pullout worksurface 150. As shown in FIG. 1B, the support frame 54 includes a plurality of upper portions 154 that are configured along a common plane to collectively support the pullout worksurface 150 throughout it full range of motion. In this embodiment, the support frame 54 also includes a pair of rails 156 to support opposite longitudinal edges of the worksurface 150. In this embodiment, the worksurface 150 is generally rectangular is substantially coextensive in length with bassinet support surface 14, but its size and shape may vary from application to application, as desired.

Figure 10A:
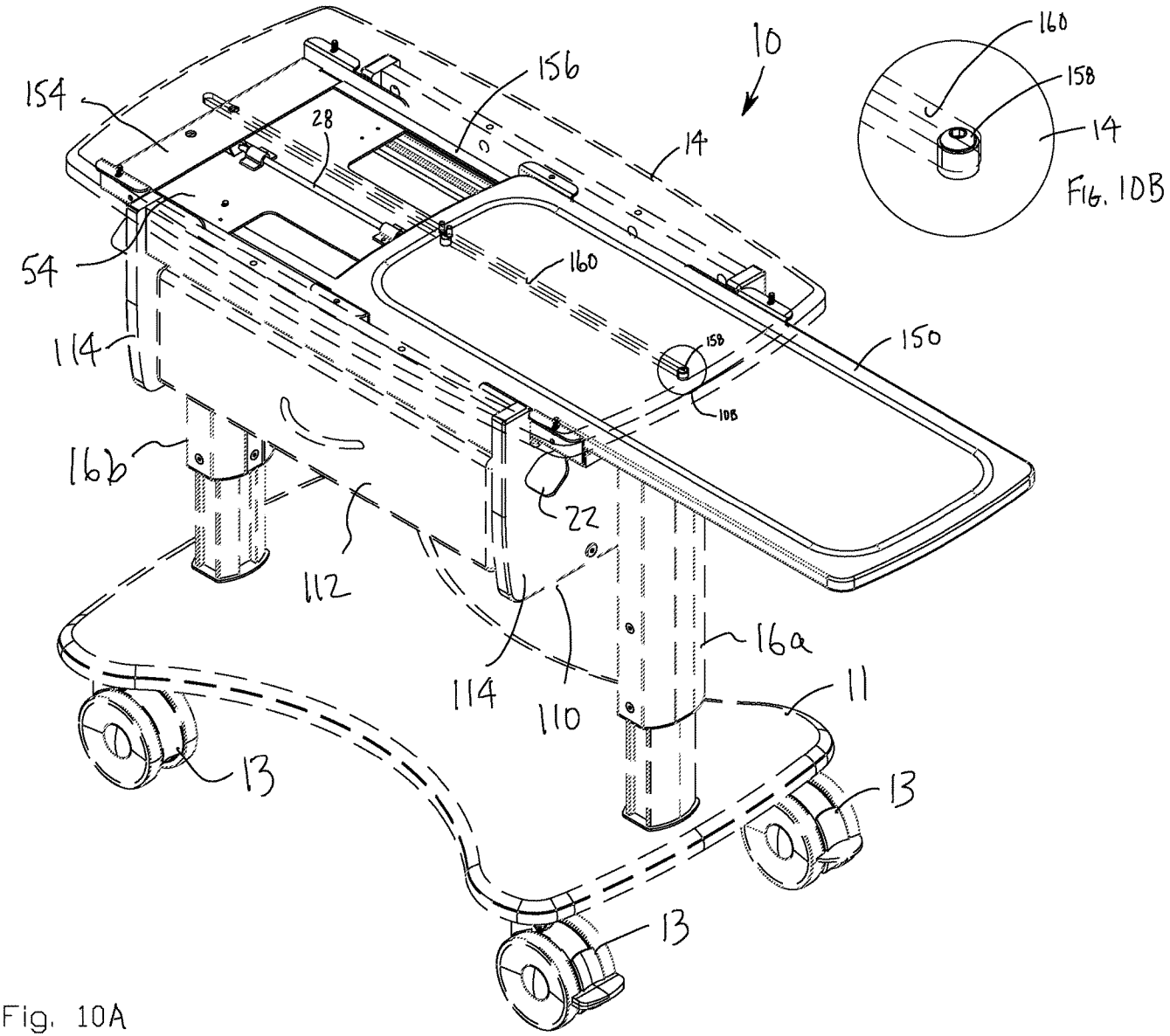
FIG. 10A is a perspective view of the bassinet with portions in broken lines to show the pullout worksurface extended from one end of bassinet.

In the illustrated embodiment, the worksurface 150 includes a stop arrangement that prevents the worksurface 150 from being pulled out too far (See FIGS. 10A and 10B). In this embodiment, the worksurface 150 includes an upwardly extending finger 158 that is positioned at the approximate center of the worksurface 150. The finger 158 extends up into a guide slot 160 defined in the bottom of the bassinet support surface 14. The finger 158 travels along the guide slot 160 as the worksurface 150 is pulled out and returned with further motion being prohibited once the finger 158 reaches the end of the guide slot 160. Accordingly, the range of motion of the pullout worksurface 150 is defined by the length of the guide slot 160. In the illustrated embodiment, the finger 158 is manufactured from a section of nylon tube, but it may be manufacture from essentially any other suitable material.

Figure 9A:
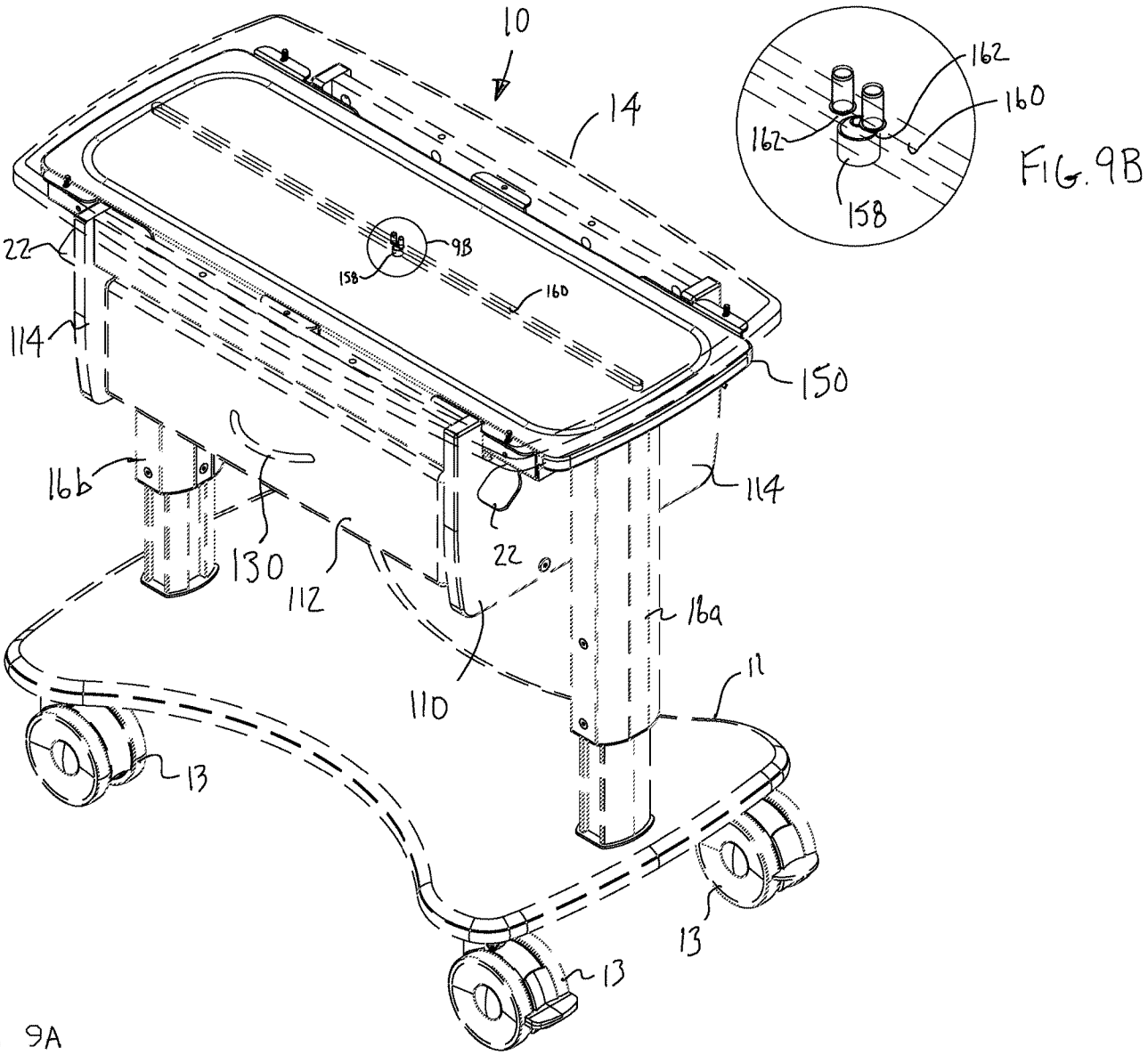
FIG. 9A is a perspective view of the bassinet with portions in broken lines to show the pullout worksurface.

In the illustrated embodiment, the pullout worksurface 150 has a centering assembly that helps to hold the worksurface 150 in the closed position, which in this embodiment is also a centered position (See FIGS. 9A and 9B). The centering assembly of the illustrated embodiment includes a pair of spaced-apart spring-loaded ball bearings 162 (e.g. ball plungers) that are set into the undersurface of the bassinet support surface 14 and extend into the guide slot 160. The ball bearings 162 are biased into an extended position in which they are positioned to interfere with movement of the finger 158 along the guide slot 160. However, the ball bearings 162 can be moved against their bias out of the path of the finger 158 if the worksurface 150 is moved with enough force. In this embodiment, the two spring-loaded ball bearings 162 are spaced apart a distance slightly greater than the width of the finger 158. When the pullout worksurface 150 is properly closed in the centered position, the finger 158 is positioned between the two ball bearings 162 and moving it out of the centered position requires the finger 158 to be moved through one of the two ball bearings 163 (depending on which way the worksurface 150 is being extended). To move the worksurface 150 out of the centered position, the worksurface 150 must be moved with sufficient force for the finger 158 to overcome the bias and move the ball bearing 162 into a retracted position. As a result, the ball bearings 162 help to retain the pullout worksurface 150 in the centered/closed position. Further, to return the worksurface 150 to the centered/closed position, the finger 158 must be moved through one of the two ball bearing 162 (depending on which way the worksurface is traveling), but not the other. As a result, the two spring-loaded ball bearings 162 provide tactile feedback that helps the user to determine when the pullout worksurface 150 is properly centered/closed. Although FIG. 10A shows the worksurface 150 extended from one end of the bassinet 10, the worksurface 150 may alternatively extend from the opposite end of the bassinet 10.

Orienting the pullout worksurface 150 to pull out from opposite ends of the bassinet 10 prevents the extended worksurface 150 from interfering with access to the drawer 112 (as the drawer 112 pulls out from the sides rather than the ends of the bassinet 10). Also, because the casters are spaced apart farther in the end-to-end direction than the side-to-side, the base 11 provides more stable support for a worksurface 150 that pulls out from the end of the bassinet 10.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A height-adjustable bassinet comprising:

a bassinet support surface having four corners, a base, a pair of columns extending upwardly from said base to support said bassinet support surface, each of said columns configured to be adjustable in length to allow selective control over the height of said bassinet support surface, each of said columns including an assist cylinder having a locked state in which said length of said column is secured and an unlocked state in which said length of said column is readily adjustable, said assist cylinders having an actuator movable to vary said assist cylinder between said locked state and said unlocked state; and a height adjustment assembly affixed below said bassinet support surface and operatively coupled to both of said assist cylinder actuators to allow a user to manually place both of said assist cylinders in said unlocked state, said height adjustment assembly including a first paddle assembly and a second paddle assembly, said first paddle assembly having a first pair of manual actuators disposed on a first side of said bassinet support surface proximate a first and a second of said corners of said table top, said second paddle assembly have a second pair of manual actuators disposed on a second side of said bassinet support surface opposite said first side, said second pair of manual actuators proximate a third and a fourth of said corners of said bassinet support surface, said height adjustment assembly including a dual linkage having a first linkage and a second linkage, said first linkage disposed between said first paddle assembly and both of said assist cylinders, said first linkage translating movement of at least one of said manual actuators in said first pair of manual actuators into movement of said actuators of both of said assist cylinders into said unlocked state, said second linkage disposed between said second paddle assembly and both of said assist cylinders, said second linkage translating movement of at least one of said manual actuators in said second pair of manual actuators into movement of said actuators of both of said assist cylinders into said unlocked state, whereby manual movement of any one of said manual actuators results in movement of both of said assist cylinders from said locked state to said unlocked state; and wherein said dual linkage includes a pair of actuator rods, each of said actuator rods being a component of said first linkage and said second linkage;

wherein said dual linkage includes a pair of drive rods, each of said drive rods being uniquely associated with one of said paddle assemblies;

wherein said dual linkage includes a plurality of pivot arms operatively disposed between said drive rods and said actuator rods; and wherein said plurality of pivot arms includes four pivot arms, each of said drive rods being operatively engaged with at least two of said pivot arms.

2. A height-adjustable bassinet comprising:

a bassinet support surface having four corners, a base, a pair of columns extending upwardly from said base to support said bassinet support surface, each of said columns configured to be adjustable in length to allow selective control over the height of said bassinet support surface, each of said columns including an assist cylinder having a locked state in which said length of said column is secured and an unlocked state in which said length of said column is readily adjustable, said assist cylinders having an actuator movable to vary said assist cylinder between said locked state and said unlocked state; and a height adjustment assembly affixed below said bassinet support surface and operatively coupled to both of said assist cylinder actuators to allow a user to manually place both of said assist cylinders in said unlocked state, said height adjustment assembly including a first paddle assembly and a second paddle assembly, said first paddle assembly having a first pair of manual actuators disposed on a first side of said bassinet support surface proximate a first and a second of said corners of said table top, said second paddle assembly have a second pair of manual actuators disposed on a second side of said bassinet support surface opposite said first side, said second pair of manual actuators proximate a third and a fourth of said corners of said bassinet support surface, said height adjustment assembly including a dual linkage having a first linkage and a second linkage, said first linkage disposed between said first paddle assembly and both of said assist cylinders, said first linkage translating movement of at least one of said manual actuators in said first pair of manual actuators into movement of said actuators of both of said assist cylinders into said unlocked state, said second linkage disposed between said second paddle assembly and both of said assist cylinders, said second linkage translating movement of at least one of said manual actuators in said second pair of manual actuators into movement of said actuators of both of said assist cylinders into said unlocked state, whereby manual movement of any one of said manual actuators results in movement of both of said assist cylinders from said locked state to said unlocked state; and wherein said dual linkage includes a pair of actuator rods, each of said actuator rods being a component of said first linkage and said second linkage;

wherein said dual linkage includes a pair of drive rods, each of said drive rods being uniquely associated with one of said paddle assemblies;

wherein said dual linkage includes a plurality of pivot arms operatively disposed between said drive rods and said actuator rods; and wherein said plurality of pivot arms includes four pivot arms, each of said actuator rods being operatively engaged with at least two of said pivot arms.

3. A height-adjustable bassinet comprising:

a bassinet support surface having four corners, a base, a pair of columns extending upwardly from said base to support said bassinet support surface, each of said columns configured to be adjustable in length to allow selective control over the height of said bassinet support surface, each of said columns including an assist cylinder having a locked state in which said length of said column is secured and an unlocked state in which said length of said column is readily adjustable, said assist cylinders having an actuator movable to vary said assist cylinder between said locked state and said unlocked state; and a height adjustment assembly affixed below said bassinet support surface and operatively coupled to both of said assist cylinder actuators to allow a user to manually place both of said assist cylinders in said unlocked state, said height adjustment assembly including a first paddle assembly and a second paddle assembly, said first paddle assembly having a first pair of manual actuators disposed on a first side of said bassinet support surface proximate a first and a second of said corners of said table top, said second paddle assembly have a second pair of manual actuators disposed on a second side of said bassinet support surface opposite said first side, said second pair of manual actuators proximate a third and a fourth of said corners of said bassinet support surface, said height adjustment assembly including a dual linkage having a first linkage and a second linkage, said first linkage disposed between said first paddle assembly and both of said assist cylinders, said first linkage translating movement of at least one of said manual actuators in said first pair of manual actuators into movement of said actuators of both of said assist cylinders into said unlocked state, said second linkage disposed between said second paddle assembly and both of said assist cylinders, said second linkage translating movement of at least one of said manual actuators in said second pair of manual actuators into movement of said actuators of both of said assist cylinders into said unlocked state, whereby manual movement of any one of said manual actuators results in movement of both of said assist cylinders from said locked state to said unlocked state; and wherein said dual linkage includes a pair of actuator rods, each of said actuator rods being a component of said first linkage and said second linkage;

wherein said dual linkage includes a pair of drive rods, each of said drive rods being uniquely associated with one of said paddle assemblies;

wherein said dual linkage includes a plurality of pivot arms operatively disposed between said drive rods and said actuator rods; and wherein said plurality of pivot arms includes four pivot arms, each of said drive rods being operatively engage with at least two of said pivot arms and each of said actuator rods being operatively engaged with at least two of said pivot arms.

4. The bassinet of claim 3 wherein said height adjustment assembly is generally symmetric about two axes extending normal to one another.

5. The bassinet of claim 4 wherein each of said paddle assemblies includes a radial leg disposed near a longitudinal center of said paddle assembly, each of said radial legs being operatively engaged with one of said drive rods.

6. The bassinet of claim 5 wherein said plurality of pivot arms includes four pivot arms arranged in a rectangular configuration.

7. The bassinet of claim 6 wherein each of said pivot arms is generally "L"-shaped having a first leg, a second leg and vertex, each of said pivot arms configured to pivot about said vertex.

8. The bassinet of claim 7 wherein each of said drive rods is operatively engaged with said first legs of two of said pivot arms; and each of said actuator rods is operatively engaged with said second legs of two of said pivot arms.

9. The bassinet of claim 5 wherein a first of said drive rods is operatively engaged with a first and a second of said pivot arms, a second of said drive rods is operatively engaged with a third and a fourth of said pivot arms; and wherein a first of said actuator rods is operatively engaged with said first and said third of said pivot arms, a second of said actuator rods is operatively engaged with said second and said fourth of said pivot arms.

10. The bassinet of claim 9 further including a support frame mounted to said columns and said bassinet support surface, said height adjustment assembly being affixed to said a support frame.

* * * * *